US005795540A

United States Patent [19]

Dwars et al.

[11] Patent Number: 5,795,540

[45] Date of Patent: Aug. 18, 1998

[54] CORROSION AND WEAR-RESISTANT CHILL CASTING

[75] Inventors: Anja Dwars, Nurnberg; Wolfgang Prechtl, Sulzbach-Rosenberg; Jorg Schropfer, Erlangen; Hermann Tischner, Pegnitz, all of Germany

[73] Assignee: KSB Aktiengesellschaft, Frankenthal, Germany

[21] Appl. No.: 716,391

[22] PCT Filed: Mar. 2, 1995

[86] PCT No.: PCT/EP95/00759

§ 371 Date: Sep. 17, 1996

§ 102(e) Date: Sep. 17, 1996

[87] PCT Pub. No.: WO95/25826

PCT Pub. Date: Sep. 28, 1995

[30] Foreign Application Priority Data

Mar. 18, 1994 [DE] Germany ..... 44 09 278.4

[51] Int. Cl.[6] ..... C22C 37/06; C22C 38/20; C22C 38/42; C22C 30/00

[52] U.S. Cl. ..... 420/12; 420/101; 420/53; 420/586.1

[58] Field of Search ..... 420/12, 101, 53, 420/55, 57, 586.1; 148/323

[56] References Cited

U.S. PATENT DOCUMENTS

| | | | |
|---|---|---|---|
| 2,709,132 | 5/1955 | Giles | 420/12 |
| 3,086,858 | 4/1963 | Edminster et al. | 420/12 |
| 4,200,457 | 4/1980 | Cape | 420/12 |

*Primary Examiner*—Deborah Yee
*Attorney, Agent, or Firm*—Darby & Darby

[57] ABSTRACT

A corrosion and wear-resistant chill cast part is formed from an iron composition comprising from 26 to 36 percent Cr; 0 to 10 percent Ni; 2 to 6 percent Mo; 0 to 3 percent Cu; 0 to 0.2 percent N; 0 to 1.5 percent Si; 0 to 1.5 percent Mn; 4 to 9 percent V; and 1.4 to 1.9 percent C. All percents are by weight of the total composition. The remainder of the composition is Fe and impurities.

8 Claims, 2 Drawing Sheets

CORROSION AND WEAR-RESISTANT CHILL CASTING

BACKGROUND OF THE INVENTION

It is known in the art to use carbon-containing chromium chill cast parts based on iron for stress from hydroabrasive wear. A cast of that type is distinguished by having a carbon content that is greater than 2.0 percent by weight. However, due to the high consumption of the available chromium to form carbide, those materials are not any more resistant to corrosion than most non-alloy cast iron.

Typically, corrosion resistance is increased by reducing the carbon content and increasing the chromium content of the composition, although reduced wear resistance must be accepted. A typical example of one of these materials is G-X 170 CrMo 25 2. One major disadvantage of these materials is that corrosion resistance in chemically aggressive media, such as, for example, acidic (pH 3) chloride-containing (50 g/l Cl) water from exhaust gas desulfuration equipment cannot be achieved, unless the chromium content is very high. However, high chromium levels in iron-based alloys, such as the known materials G-X 160 CrNiMoCu 42 2 2 2 or G-X 140 CrMnNiMoCu 41 4 2 2 1, have the disadvantage of having poor mechanical properties and impaired casting properties.

For this reason, corrosion-resistant specialty steels whose wear resistance can be easily improved by lowering the carbon content (<0.5%) and the resulting smaller proportion, by volume, of carbides are used for the aforementioned aggressive media. The formation of chromium carbides reduces the chromium content of the basic structure, and the corrosion resistance declines accordingly. Therefore, it is not advisable to increase the carbon content further.

One way to avoid chromium depletion in a composition matrix with higher carbon contents is to add other carbide-forming elements. This is achieved in steels with low chromium contents (<20%), which are exposed to slightly corrosive media. An example is described in DE-A-42 02 339. The addition of niobium was considered to be particularly advantageous, because that alloy element forms pure MC carbide. The element vanadium was not considered beneficial because it reacts with chromium and iron to form composite carbides, which are less wear resistant.

Attempts to increase the chemical-tribologic resistance of the high-chromium material 1.4464 by adding small amounts of niobium, vanadium, or titanium are also known (M. Pohl, A. Ibach, A. Oldewurtel: New Cast and Forged Steel with Improved Chemical/Tribologic Resistance. Proceedings of the Fifth TRIBOLOGY Presentation 1991, Koblenz, pp. 368–376). However, in some cases as a result of the low carbon content, corrosion resistance could be improved only slightly.

SUMMARY OF THE INVENTION

An object of the invention is to provide a metallic casting material (composition) that is distinguished by exhibiting high corrosion resistance in aggressive media and that approaches the wear resistance of parts formed by standard chill casting processes.

This object is achieved by chill casting parts having the composition comprising from 26 to 36 percent Cr; 0 to 10 percent Ni; 2 to 6 percent Mo; 0 to 3 percent Cu; 0 to 0.2 percent N; 0 to 1.5 percent Si; 0 to 1.5 percent Mn; 4 to 9 percent V; and 1.4 to 1.9 percent C; all percents by weight of the total composition; wherein the remainder of the composition is Fe and impurities.

In addition to high resistance to corrosion and wear, this casting material also has good casting properties. Thus, it can be produced in conventional special steel foundries. In addition, this chill casting material has good working properties.

The object of the invention is achieved with a composition comprising a chromium content from 26 through 36 percent by weight and a carbon content of 1.4 through 1.9 percent by weight, which causes a sufficiently high proportion by volume of carbides, and a vanadium content of greater than 4 percent by weight, which reduces chromium depletion in the matrix by forming high-vanadium carbides. This makes it possible to avoid the disproportionate increase in chromium content that would be necessary without the use of vanadium.

There are further advantages which result from adding vanadium. Vanadium is an element from the fifth transition group, and its associated carbides are distinguished by possessing good wetting properties and lower solubility than chromium carbide in iron-based alloys. At the same time, it is more soluble, in the liquid state, than niobium carbide is, which means that high-vanadium carbides typically do not form until a later stage of solidification or until the solid state occurs, producing an even spatial distribution of the carbides without gravitational segregation. This is a prerequisite for achieving good wear resistance.

In addition, high-vanadium carbides have been found to be equal to other special carbides in imparting wear resistance. Moreover, the high-vanadium composite carbides are beneficial from the viewpoint of fracture mechanics due to their form and the resulting low notch effect. The vanadium remaining in the matrix is not detrimental to the mechanical properties.

The molybdenum content within the indicated limits is important for corrosion resistance, particularly in acid media containing chloride ions.

The copper content is preferably less than 3 percent by weight in order to reduce the risk of cracking when casting thick-walled parts. Low copper contents improve corrosion resistance in oxidizing media and are therefore used in standard high-alloy compound steels. Another advantage of the copper content allowed by the material of the invention is the capability of using recycled material from standard high-alloy cast steel for steel production.

By adding nickel, which forms austenite, in a concentration from 6 to 10 percent by weight, the relationship of the ferrite and austenite phase portions in the matrix can be adjusted according to definition. The positive properties of a compound structure in stainless steels are known. The extremely high brittleness of chill casting varieties with high carbon contents and a carbide network in a ferrite matrix is avoided by the preponderantly interstitial high-vanadium carbides in the austenitic phase. Because, in contrast to the ferrite phase, those carbides are not embrittled by precipitation of intermetallic phases or by segregation processes, the risk of cracks in the case of tension between carbides and the matrix is not as great as in a purely ferritic matrix.

To achieve a structure made up of a ferrite-austenite matrix with interstitial carbides, heat treatment at the usual solution heat temperatures is necessary, which simultaneously improves working properties.

Additional heat treatment according to the time-temperature-transformation curves of high-alloy steels also makes it possible to increase hardness by taking advantage of the known tendency of ferrite to form precipitates, to further increase wear resistance.

A maximum of 4 percent by weight niobium can be added to the chill casting composition, in order to allow the possibility of a secondary precipitation of eutectoid niobium carbides, which can increase wear resistance. The niobium content is limited to a maximum of 4 percent by weight to avoid the precipitation of primary niobium carbides in the molten mass, because they strongly segregate due to the difference between their density and that of the matrix.

In contrast with the known chromium chill casting parts made from known processes, the material of the present invention has very low susceptibility to corrosion, particularly to selective corrosion, due to the low chromium content of the carbides.

An additional advantage of this material is that at a given wear resistance, the corrosion resistance can be adjusted by varying the alloy elements that are relevant to corrosion chemistry, according to the profile of the given requirements. However, it must be kept in mind that as the alloy content increases, production (casting and metal cutting properties) becomes more difficult.

In regard to the combination of corrosion resistance and wear resistance, the materials of the present invention are superior to the chill casting materials of the prior art that have been used for hydroabrasive wear.

This can be shown using the example of a comparison of three material compositions of the invention that are contrasted with four chill casting process materials of the prior art.

DETAILED DESCRIPTION OF A PREFERRED EMBODIMENT

Figure 1:
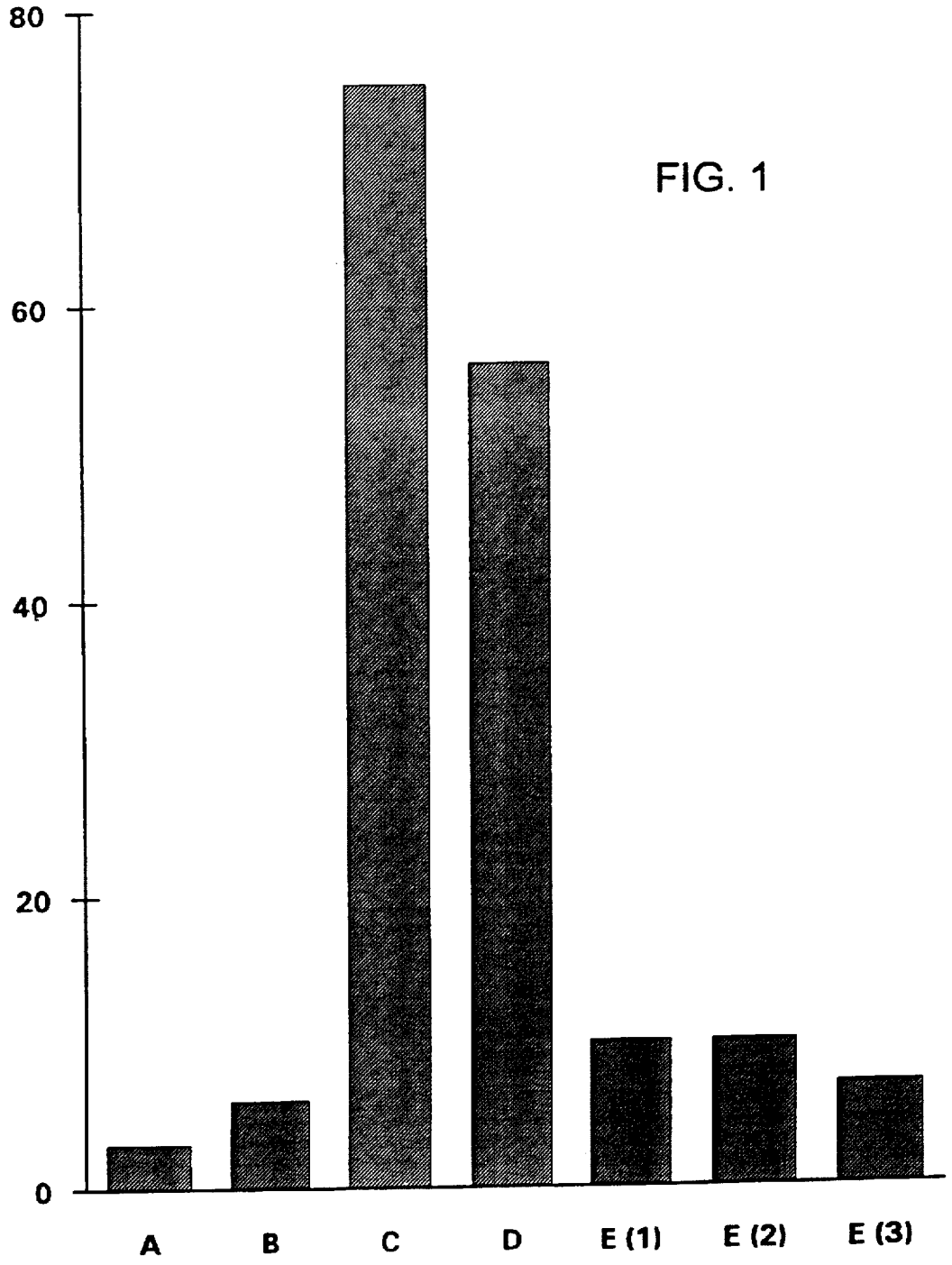
FIG. 1 is a graphic illustration of the wear rates of materials under hydroabrasive wear.

To determine the wear rates shown in FIG. 1, a model wear device was used in which the corrosion agent was a 1:1 mixture of water and quartz sand having a grain size of 0.9–1.2 mm. Each test lasted two hours. A rotation speed of 3,000 l/minute was used. Each sample part was 55 mm in diameter and 5 mm thick.

Figure 2:
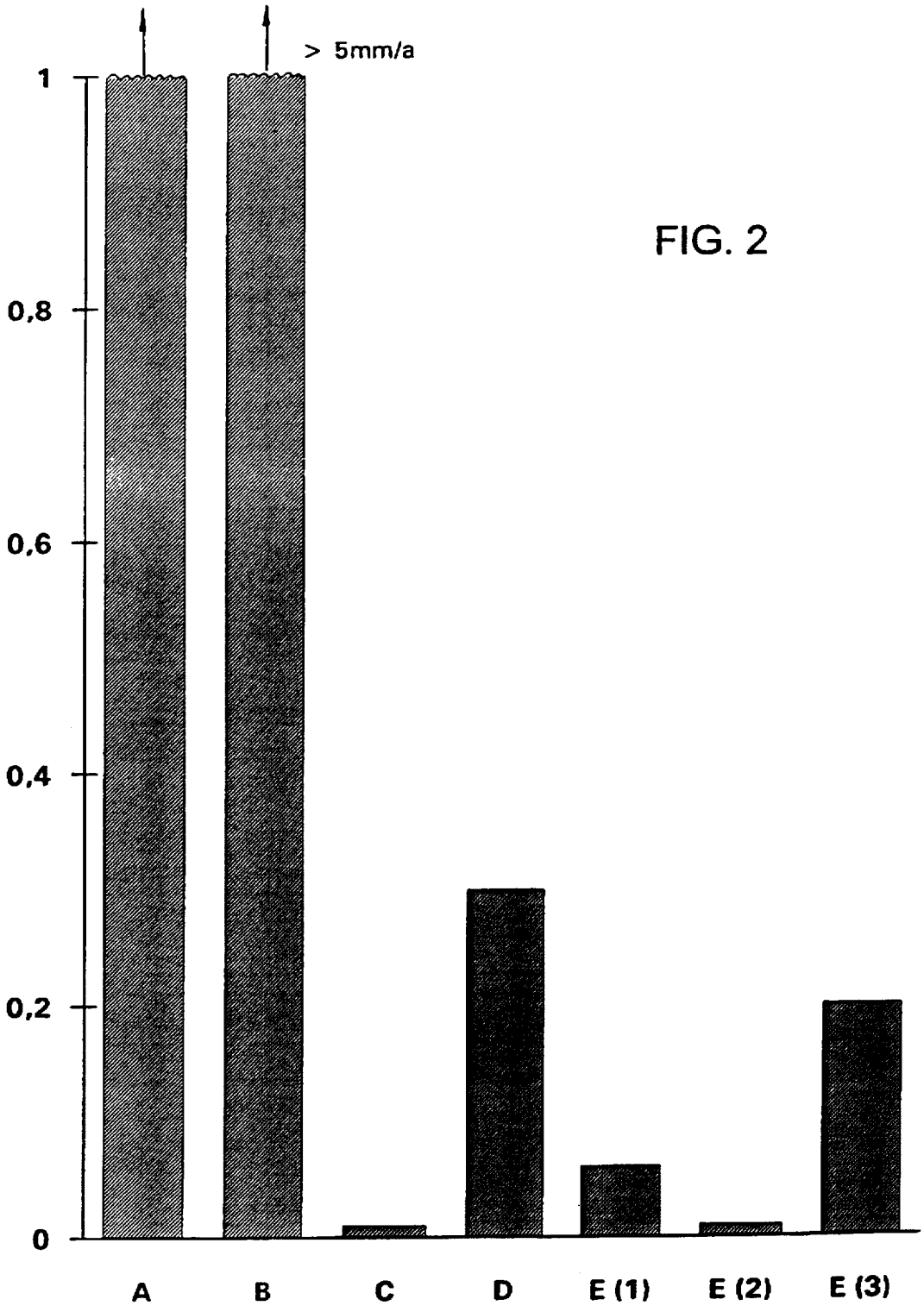
FIG. 2 is a graphic illustration of the corrosion rates in a highly acid medium (pH 0.5; 10 g/l Cl—; 60° C.).

The Y-axes of the diagrams shown in FIGS. 1 and 2 indicate the wear in mm/a. On the X-axes, the letters A through D indicate the materials of prior art, which are explained in Table 1 below, while references E (1) through E (3) are the three compositions of the invention, these compositions are shown in Table 2.

TABLE 1

Materials of prior art used in the tests

| Reference | Short name |
|---|---|
| A | G-X 250 CrMo 15 3 |
| B | G-X 170 CrMo 25 2 |
| C | G-X 3 CrNiMoCu 24 6 |
| D | G-X 40 CrNiMo 27 5 |

TABLE 2

Alloy composition of the materials in accordance with the invention that were used in the tests

| Ref. | C | Si | Mn | Cr | Ni | Mo | Cu | V | Fe |
|---|---|---|---|---|---|---|---|---|---|
| E(1) | 1.5 | 0.8 | 0.6 | 26.6 | 7.9 | 2.6 | 1.8 | 5.2 | Remainder |
| E(2) | 1.5 | 1.2 | 0.8 | 30.1 | 8.2 | 2.4 | 1.7 | 5.0 | Remainder |
| E(3) | 1.8 | 0.8 | 0.9 | 31.8 | 8.7 | 2.8 | 1.8 | 8.9 | Remainder |

We claim:

1. A corrosion and wear-resistant chill cast part wherein said part is formed from an iron composition comprising from 26 to 36 percent Cr; 0 to 10 percent Ni; 2 to 6 percent Mo; Cu being present in an amount less than or equal to 3 percent; N being present in an amount less than or equal to 0.2 percent; 0 to 1.5 percent Si; 0 to 1.5 percent Mn; 4 to 9 percent V; and 1.4 to 1.9 percent C; all percents by weight of the total composition; wherein the remainder of the composition is Fe and impurities.

2. The chill casting part according to claim 1, wherein the nickel content is from 6 to 10 percent by weight.

3. The chill cast part according to claim 1, wherein said composition comprises up to 4 percent by weight of niobium.

4. The chill cast part according to claim 2 wherein said composition comprises from up to 4 percent by weight of niobium.

5. A chill cast part that contacts a flowing corrosive media, optionally containing solids; wherein said part is formed with an iron composition comprising from 26 to 36 percent Cr; 0 to 10 percent Ni; 2 to 6 percent Mo; Cu being present in an amount of less than or equal to 3 percent; N being present in an amount less than or equal to 0.2 percent; 0 to 1.5 percent Si; 0 to 1.5 percent Mn; 4 to 9 percent V and 1.4 to 1.9 percent C; all percents by weight of the total composition, wherein the remainder of the composition is Fe and impurities.

6. A chill cast part according to claim 5, wherein the composition comprises from 0 to 4 percent by weight Niobium.

7. A chill cast part according to claim 5, wherein said part is a pump.

8. A chill cast part according to claim 5, wherein said part is an armature.

* * * * *